United States Patent [19]

Eichinger

[11] 4,354,846

[45] Oct. 19, 1982

[54] NONSTEERABLE DRIVE MECHANISM FOR A WATERCRAFT

[75] Inventor: Johann Eichinger, Vaterstetten, Fed. Rep. of Germany

[73] Assignee: Carl Hurth Maschinen- und Zahnradfabrik GmbH & Co., Munich, Fed. Rep. of Germany

[21] Appl. No.: 249,291

[22] Filed: Mar. 30, 1981

Related U.S. Application Data

[63] Continuation of Ser. No. 9,226, Feb. 2, 1979, abandoned.

[30] Foreign Application Priority Data

Feb. 10, 1978 [DE] Fed. Rep. of Germany ..... 2805688

[51] Int. Cl.[3] ..... B63H 21/28

[52] U.S. Cl. ..... 440/52

[58] Field of Search ..... 440/49, 52, 53, 75, 440/111, 112, 57, 58; 61/52–63, 111, 112

[56] References Cited

U.S. PATENT DOCUMENTS

| | | | |
|---|---|---|---|
| 1,793,888 | 2/1931 | Whitehouse | 64/11 R |
| 1,807,622 | 6/1931 | Colstad | 440/49 |
| 2,586,019 | 2/1952 | Frohlich | 440/112 |
| 3,010,422 | 11/1961 | Brakensiek | 440/49 |
| 3,013,519 | 12/1961 | Wiggermann | 440/58 |
| 3,376,842 | 4/1968 | Wynne | 440/57 |
| 3,624,738 | 11/1971 | Gill | 440/52 |
| 3,707,082 | 12/1972 | Ulics | 64/11 B |

FOREIGN PATENT DOCUMENTS

| | | | |
|---|---|---|---|
| 983462 | 2/1965 | United Kingdom | 440/58 |

*Primary Examiner*—Trygve M. Blix
*Assistant Examiner*—Jesús D. Sotelo
*Attorney, Agent, or Firm*—Blanchard, Flynn, Thiel, Boutell & Tanis

[57] ABSTRACT

A nonsteerable drive mechanism for a watercraft which includes an upper part arranged within the watercraft and has a drive motor with a downwardly directed driving shaft. A lower part is arranged outside of the hull of the watercraft and has an angled gear arrangement, the driven shaft of which extends horizontally below the waterline in the lower part and has a propeller fixedly secured to its free end. The upper part is resiliently mounted to a base plate and the lower part, independently therefrom, is rigidly secured to the base plate. A fixed closure member closes off an opening through the hull and a part of the base plate encircling the opening of the watercraft, which closure member is sealingly penetrated through by a shaft connection connected to the angled gear arrangement. The power transmission from the upper part to the lower part takes place through an elastic coupling connecting the driving shaft to the shaft connection.

10 Claims, 3 Drawing Figures

NONSTEERABLE DRIVE MECHANISM FOR A WATERCRAFT

This is a continuation of application Ser. No. 9,226, filed Feb. 2, 1979, now abandoned.

FIELD OF THE INVENTION

The invention relates to a drive mechanism for a watercraft, in which a motor arranged within the watercraft, if desired with the interpositioning of a reversing and/or reduction gearing, drives a propeller secured to a substantially horizontal shaft through a shafting which extends through the hull of the watercraft and an angled gearing arrangement.

BACKGROUND OF THE INVENTION

Such mechanisms are often installed in sailboats and the like and are identified as an auxiliary drive therefor. However, they can be used also as a primary drive for smaller motor boats and for lateral thrust rudders and the like in smaller ships.

In a known construction (Motor Boat and Yachting, November 1977, Page 13) the drive motor is flange connected to a gear housing having a gearing aggregate therein, which contains two cone-pulley drives. The entire unit is secured on a base plate which is connected to the hull, which base plate—just like the hull—has an opening therethrough through which projects the gearing aggregate and the propeller which is arranged on its driven shaft. This compact manner of construction of the drive mechanism permits a removal of the motor only with the gearing aggregate attached thereto. Thus, the removal cannot take place as long as the boat is in the water. In addition, the propeller thrust is transmitted onto the hull through the screws which hold the entire drive mechanism to the hull.

A different design, in which the drive motor is arranged above the gearing aggregate (German OS No. 25 25 838) has principally the same disadvantages.

Therefore, the basic object of the invention is to provide a drive mechanism for watercrafts, in which the aggregates which are arranged within and outside of the hull can be secured independently from one another in or on the watercraft and in particular the drive motor can be installed and removed also when the vessels are in the water. Furthermore, the propeller thrust is transmitted via a short route onto a base plate secured to the hull.

It is suggested in order to attain the object to secure the drive motor and a first angle gear arrangement having a downwardly driven shaft resiliently to a base plate which closes off an opening in the hull, while the lower part which includes a second angled gear arrangement, the horizontally extending driven shaft carries the propeller, is secured rigidly to the base plate. The power transmission from the upper part to the lower part is accomplished through an elastic coupling arranged therebetween. By deleting the first angled gear arrangement, this arrangement can also be used when a drive motor having a downwardly directed driven shaft is used.

The upper part is secured preferably from the inside of the boat and the lower part from the outside. When the lower part is mounted in various positions with respect to the upper part, the possibilities of use of the device are increased.

Good operating results are brought about by couplings having universal joint characteristics and wherein the coupling is protected by a sleeve.

The installation of the base plate into the hull is substantially eased if it is centered in the hull. At least in the cases, where an internal combustion engine is used as a drive motor, the first angled gear arrangement is a reversing gear.

BRIEF DESCRIPTION OF THE DRAWINGS

The invention will be described hereinafter with reference to one exemplary embodiment illustrated in FIGS. 1 and 2.

In the drawings.

DETAILED DESCRIPTION

Figure 1:
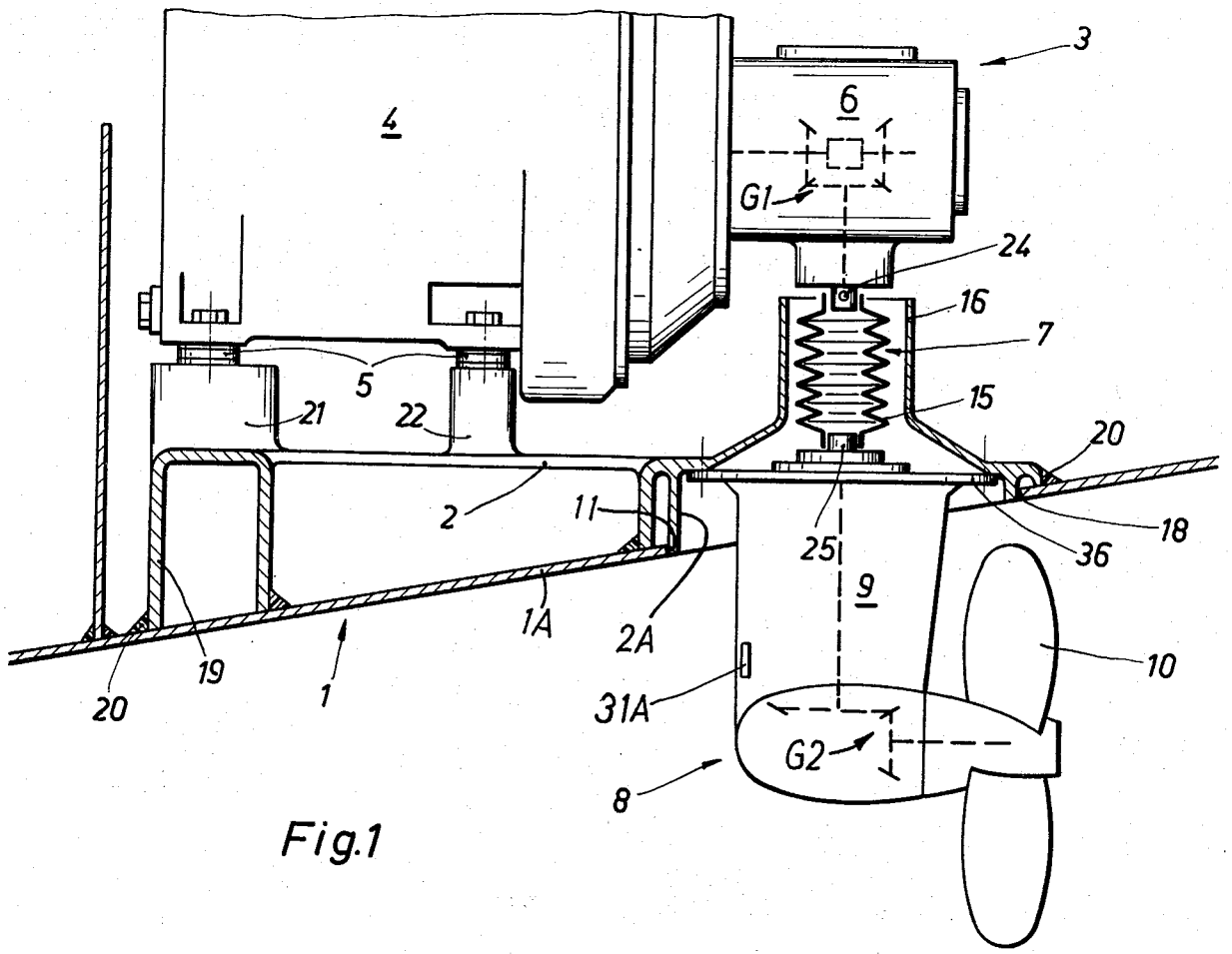
FIG. 1 is a simplified illustration of a drive mechanism embodying the invention with a motor having a horizontal driven shaft.

FIG. 1 illustrates a cross-sectional view of a portion of the hull 1 of a watercraft, namely, a portion of the bottom wall 1A of the hull. A base plate 2 or the like is mounted over an opening 11 in the bottom wall 1A of the hull for supporting the drive mechanism 3, 4, 8. The base plate 2 has reinforcing ribs 19 thereon which engage the bottom wall 1A of the boat and effect a spacing of the base plate above the bottom wall 1A of the hull. The base plate, including the reinforcing ribs thereon, is designed such that it can be formed in a simple manner to the respective shape of the hull. The hull and the base plate are made of a glassfiber-reinforced plastic or the like and are connected at 20 by means of an adhesive or other suitable methods. To achieve a proper location of the base plate with respect to the hull, the base plate has an annular downwardly extending flange 2A centered in the opening 11 as at 18.

The base plate 2 has supporting embossments 21, 22 on its upper surface to which embossments is secured a drive motor 4 as by bolts. Vibration isolators 5 are positioned between the motor 4 and the upper surface of the embossments. The motor 4 is illustrated only schematically as is the first angled gear arrangement G1 in the gear housing 6 which is connected through a flanged connection to the output end of the motor. Both aggregates together form the so-called upper part 3. If the motor is an internal combustion engine or a different, non-reversible motor, then a reversing gear is used as the angled gear arrangement G1, as is shown in U.S. Pat. No. 4,118,996, assigned to the same assignee as is the present disclosure. The driven shaft 24 of the angled gear arrangement is vertically aligned.

Figure 3:
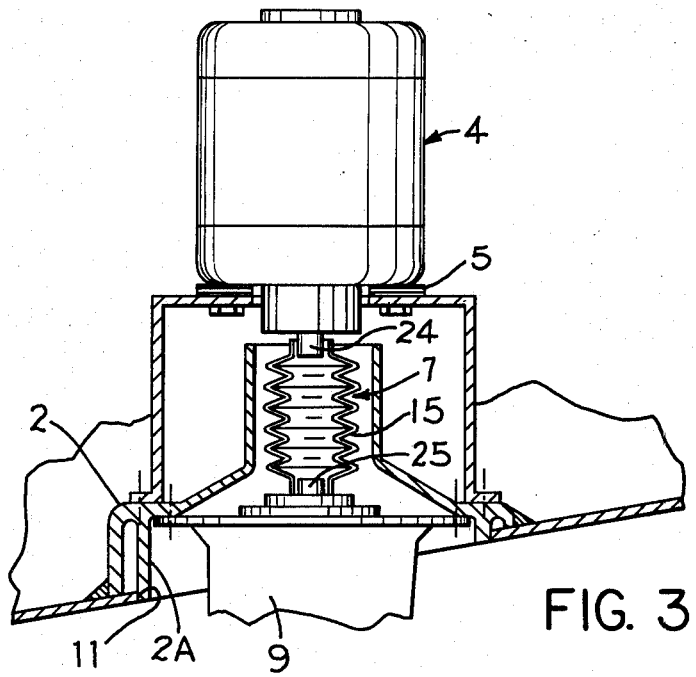
FIG. 3 is a schematic illustration of an arrangement wherein an electric motor or a hydro motor is used as the direct drive to the lower part.

Of course, it is also possible to use in place of the internal combustion engine with the flange connected gear housing a motor having a downwardly directed driving shaft, for example a hydro unit or an electric motor, which is secured resiliently directly or by the interpositioning of gearing to the base plate as shown schematically in FIG. 3.

A second angled gear arrangement G2 is mounted in the underwater housing 9 which is rigidly secured to a vertically extending driven shaft 25 positioned below the driven shaft 24 on the base plate 2, which will be discussed more in detail below. A propeller 10 is fixedly mounted to the free end of a horizontally extending shaft in a conventional manner in the underwater housing 9. The angled gear arrangement G2 and the propeller 10 form the so-called lower part 8. The shafts 24, 25 which are opposed to one another are sealed off at the exit locations from the housings 6, 9 against oil leakage and are connected to one another by means of an elastic coupling 7. This coupling can be formed by two rubber-joint sleeves 13 (FIG. 2), the hub portions 26, 27 of which are fixedly mounted on the shafts 24, 25 and the outer portions of which are connected to one another through a pipe 14 or the like. However, it is also possible to use any other desired elastic or resilient coupling, for example a metal bellows 15 (FIG. 1). At any rate, however, the restoring torque from the power transmission to the coupling is to be less than the torque which orginates from the motor vibrations and acts onto the coupling in every direction. The lower hub portion 27 (FIG. 2) is mounted on a shoulder of the driven shaft 25. A sleevelike collar 16 extends upwardly from the base plate 2 and encircles the elastic coupling 7. A radial spacing 17 is provided between the outer diameter of the sleeve and the inner diameter of the collar so that the collar will protectively surround the coupling.

Figure 2:
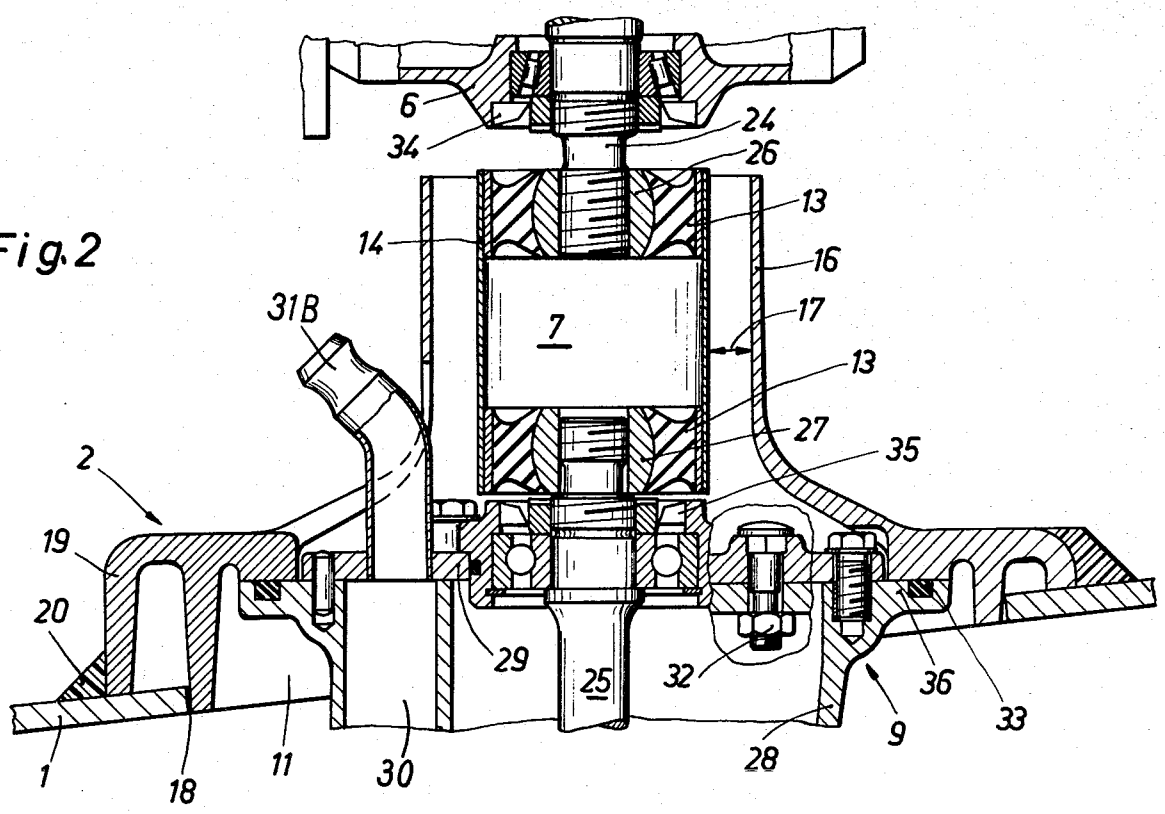
FIG. 2 illustrates in an enlarged scale the connection of the upper and lower parts to one another and to the base plate through an elastic coupling.

The illustrated exemplary embodiment according to FIG. 2 illustrates a lower part 8 having an upwardly open housing 28, which is closed off by an oil and water-tight lid 29. Of course, the lid 29 can be included into the cast part of the housing 28, which, however, is disadvantageous of the casting and the installation. Further, a longitudinally divided housing is possible, it offers—aside from additional sealing surfaces—both advantages for the casting techniques and also installation advantages. Cooling water is supplied to the motor, particularly to a cast-in chamber 30 in the lower part 8 and through an inlet opening 31A and a connecting piece 31B, to which is connected a not shown hose which extends to the motor. The entire lower part 8 is secured to the base plate 2 by any convenient fastener 32. An annular rubber ring 33 which is inserted into an annular groove seals off the opening which exists in the base plate 2 to prevent water from entering into the region of the coupling 7.

The flange 36, with which the lower part 8 is secured to the base plate 2 has an oval shape with the major axis extending parallel to the longitudinal axis of the watercraft. As a result, the area of the opening 11 in the hull can be kept small. A symmetrical arrangement of the screws 32 permits a fastening of the lower part in two positions, so that—depending on the type of construction of the watercraft—the propeller may lie in front of or behind the lower part. If the flange 36 is circular in design, which, however, requires a larger opening 11, then the lower part 8 may be attached in such a manner that the propeller thrust is directed transversely with respect to the motor or at any desired angle thereto, which is desirable at times for lateral thrust rudders or in twin screw systems.

An inventive drive mechanism according to the described exemplary embodiment has a series of advantages:

small opening 11 in the hull, since the lower part 8 does not need to be guided through the opening;

upper part 3 and lower part 8 can be mounted separately;

the motor 4 can be changed, while the vehicle is in the water;

the lower part can be detached, without having to remove the motor from its mountings;

problemless sealing off of the opening 11 in the hull;

the propeller thrust does not load the motor securement 5;

the lower part 8 can be mounted in various positions with respect to the upper part 3;

the lower part 8 can be used for various types of motors or for various types of construction of the upper part 3.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a drive mechanism for a watercraft having an opening through a hull, said drive mechanism comprising an upper part which is arranged within said watercraft and a lower part which is arranged outside of said watercraft and having an input shaft, and drive means including a downwardly directed driving shaft and an angled gear arranged in said lower part, said lower part having a driven shaft extending substantially horizontally below the waterline and a propeller fixedly secured to an end of said driven shaft, the improvement comprising a base plate means on the interior of said hull, said base plate means including means thereon encircling said opening, resilient mounting means for resiliently mounting said upper part to said base plate means, a closure member for sealingly closing said opening, said closure member being sealingly, fixedly secured by connecting means to the outside of said base plate means so that it can be removed from said base plate means without necessitating a removal of said upper part from said base plate means and, similarly, said upper part can be removed from said base plate means without necessitating a removal of said lower part, rigid mounting means for rigidly mounting said lower part to said closure member, said input shaft sealingly extending through said closure member into the interior of said hull, and an elastic coupling connecting said driving shaft to said input shaft.

2. The drive mechanism according to claim 1, wherein said connecting means is independent of said resilient mounting means so that a removal of said upper part is possible without water penetrating into the watercraft.

3. The drive mechanism according to claim 1, including means for facilitating a securement of said lower part to the outside of said base plate means in various angular positions relative to the longitudinal axis of said watercraft.

4. The drive mechanism according to claim 1, wherein said elastic coupling is formed by two vibration isolating sleeves which are connected with one another to thereby define a universal joint.

5. The drive mechanism according to claim 1, wherein said elastic coupling includes a metal bellows.

6. The drive mechanism according to claim 1, wherein a pipe-shaped sleeve extends upwardly from the inside portion of said base plate means and encircles said opening and said elastic coupling and is radially outwardly spaced therefrom.

7. The drive mechanism according to claim 1, wherein said drive means includes an internal combustion engine and a further angled gear arrangement in said upper part from which extends said downwardly extending driving shaft.

8. The drive mechanism according to claim 7, wherein said further angled gear arrangement is a bevel-gear reversing gear.

9. The drive mechanism according to claim 1, wherein said drive means includes an electric motor having the downwardly extending driving shaft forming the output member thereof.

10. The drive mechanism according to claim 1, wherein said drive means includes a hydro motor having the downwardly extending driving shaft forming the output member thereof.

* * * * *